US005133472A

United States Patent [19]

Koda et al.

[11] Patent Number: 5,133,472

[45] Date of Patent: Jul. 28, 1992

[54] LAUNDRY BASKET AND HANDLE THEREFOR

[75] Inventors: Walter P. Koda, Newtown; Paul Santarisiero, Avon, both of Conn.; William Seabolt, Pickerington, Ohio

[73] Assignee: Mobil Oil Corporation, Fairfax, Va.

[21] Appl. No.: 606,213

[22] Filed: Oct. 31, 1990

[51] Int. Cl.[5] ..... B65D 25/00

[52] U.S. Cl. ..... 220/94 R; 220/643

[58] Field of Search ..... 220/95, 85 K, 640, 642, 220/655, 94 R, 643

[56] References Cited

U.S. PATENT DOCUMENTS

| | | | |
|---|---|---|---|
| 2,146,415 | 2/1939 | Bradley | 220/95 |
| 2,191,291 | 2/1940 | Smith | 220/642 X |
| 2,371,639 | 3/1945 | Mason | 220/94 R |
| 2,555,926 | 6/1951 | Hendrick | 220/642 |
| 3,419,182 | 12/1968 | Gildart | 220/643 |

*Primary Examiner*—Steven M. Pollard

*Attorney, Agent, or Firm*—Alexander J. McKillop; Charles J. Speciale

[57] ABSTRACT

A laundry basket and a handle assembly therefor are disclosed. The laundry basket includes a walled container including a peripheral rim and a hand opening adjacent the rim. A handle extends about the rim and through the hand opening. The handle is preferably constructed from two pieces which are snapped together above and below the rim. Each piece includes a curved exterior surface to facilitate lifting and carrying the basket. The rim of the basket preferably includes an opening above the hand opening to facilitate the interlocking of the upper and lower pieces forming the handle.

11 Claims, 6 Drawing Sheets 38
64
36A
6
40
54
92
6
16
32
30
28
26
22
24
7
68
66
10
14
70
7
36B
74
84
72
70
68

LAUNDRY BASKET AND HANDLE THEREFOR

BACKGROUND OF THE INVENTION

1. Field of the Invention

The field of the invention relates to laundry baskets of the type including peripheral rims, and handles for allowing such baskets and the like to be carried.

2. Brief Description of the Prior Art

Rimmed containers such as laundry baskets are frequently provided with integrally formed handle portions to facilitate lifting or carrying them. Such baskets are often molded from a polymeric material into any of the basic basket shapes (e.g. round, rectangular or elliptical). The handle portions are formed in opposing sides of the basket.

The integral, molded handles provided with conventional molded laundry baskets and the like provide little more than a narrow rim or lip for the user to grasp. Such narrow rims usually allow no more than finger tip support from human hands. Such support results in the user's knuckles being extended relatively far beyond the ends of the basket where they are vulnerable to bumping against door frames and other objects. Even more importantly, the edges of the handle may cut or hurt the user's hands.

A further disadvantage of conventional, integrally molded laundry basket handles is their tendency to break or tear. Since the baskets may often contain relatively heavy loads, such breakage can render the basket essentially useless.

SUMMARY OF THE INVENTION

It is an object of the invention to provide a laundry basket which may be comfortably gripped by a user.

It is another object of the invention to provide a laundry basket which is relatively durable and safe to use.

A still further object of the invention is to provide a laundry basket which is aesthetically appealing.

A still further object of the invention is to provide a handle assembly which may be assembled to rimmed containers such as laundry baskets to facilitate lifting and carrying thereof.

In accordance with these and other objects of the invention, a laundry basket is provided which comprises a walled container having a peripheral rim and a pair of opposing hand openings adjacent the rim. A pair of handle members extend, respectively, about the rim and through the respective hand openings. The handle members each preferably include interlocked top and bottom portions which are positioned above and below the rim. Each bottom portion preferably includes a curved exterior surface which defines an upper boundary of one of the hand openings.

The peripheral rim of the laundry basket is preferably formed by a generally horizontal portion and a downwardly extending portion. The downwardly extending portion is in opposing relation to the exterior surfaces of the walls of the basket. The bottom portions of the handle members are at least partially positioned between the downwardly extending portion of the rim and the exterior surfaces of the basket. The bottom portion may further include an elongated slot which accepts either the downwardly extending rim portion or a portion of the basket wall above a hand opening.

A hand assembly is also provided for securement to a rimmed container such as a laundry basket. The handle assembly includes a bottom portion having an elongate and at least generally semicylindrical body. The body includes an elongate slot which is capable of receiving a wall or rim portion of a container. The assembly further includes a top portion having an elongate and at least generally cylindrical body. Means are provided for locking the top portion to the bottom portion. The locking means preferably include a male locking member extending from the top portion of the handle assembly and a female locking member formed by the bottom portion thereof.

DETAILED DESCRIPTION OF THE INVENTION

Figure 1:
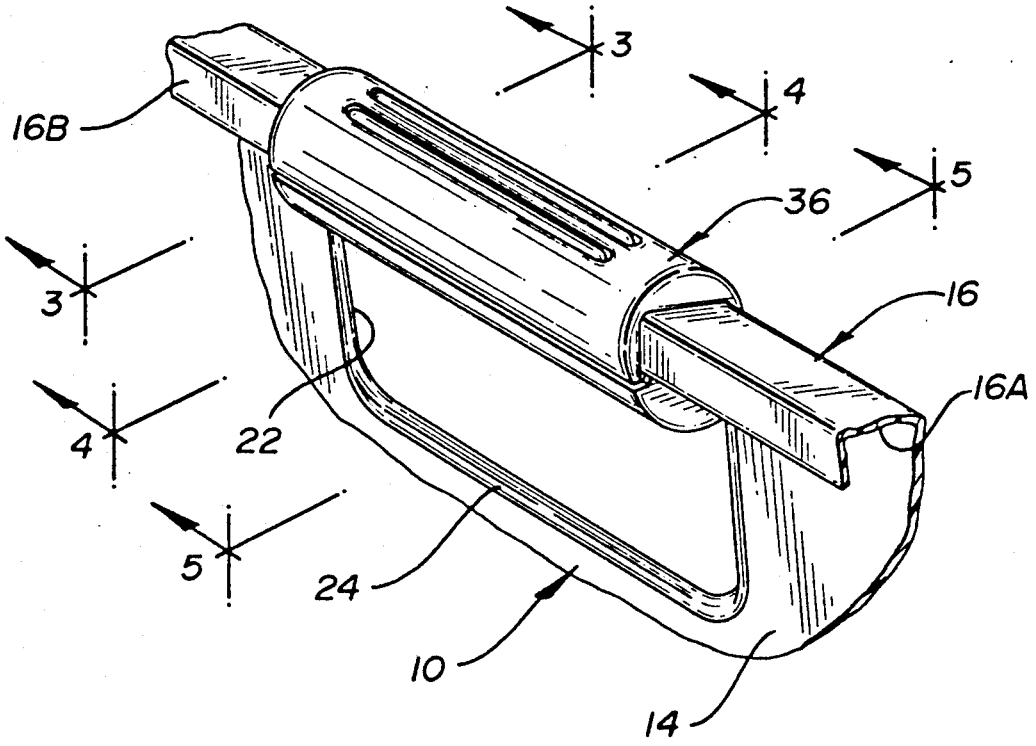
FIG. 1 is a perspective view of a wall and rim of a laundry basket including a handle according to the invention.
Figure 10:
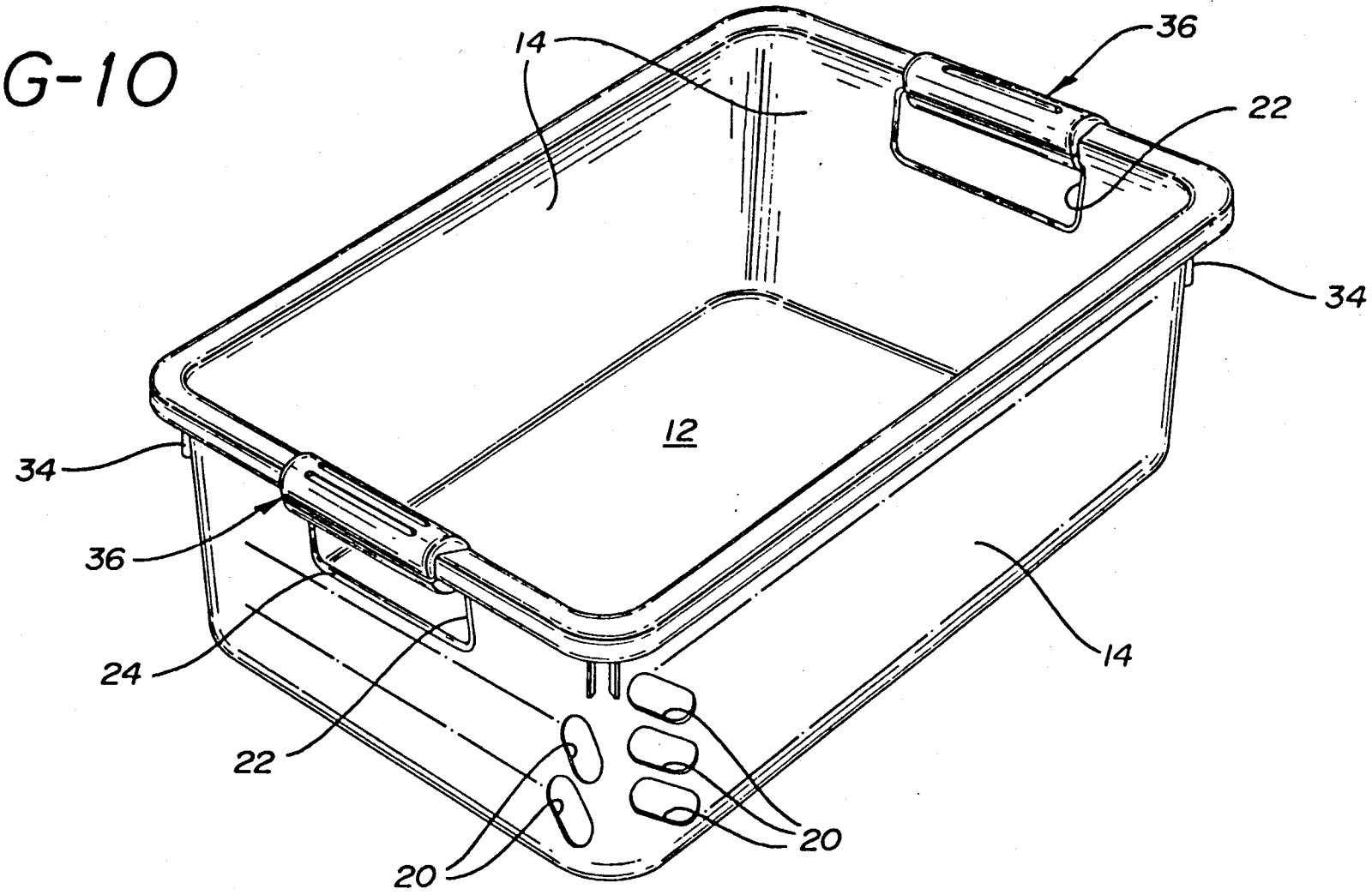
FIG. 10 is a top perspective view of a laundry basket in accordance with the invention.

Preferred embodiments of a laundry basket and a handle assembly according to the invention are shown in the drawings and described below. Referring to FIGS. 1 and 10, a laundry basket 10 having a rectangular configuration is shown. Other configurations could alternatively be employed.

The laundry basket 10 includes a bottom wall 12 and a plurality of side walls 14. A peripheral rim 16 extends from the tops of the side walls. The rim 16 includes a generally horizontal portion 16A and a downwardly extending portion 16B. The downwardly extending portion 16B is in opposing relation to the exterior surfaces of the basket side walls 14. The generally horizontal rim portion preferably forms a slightly obtuse angle with the side walls 14, and is accordingly slightly upwardly inclined. This rim construction provides a safe exterior surface which functions as a flexible bumper in the event the basket contacts a door frame or other item. The relatively large width of the generally horizontal portion 16A of the rim, which is about one inch, provides superior strength.

The side walls 14 of the basket include a plurality of openings 20 (as shown in FIG. 10) distributed over substantial portions thereof, thereby providing good ventilation within the basket. Hand openings 22 are provided within two opposing walls of the basket. (If the basket is circular, the hand openings are positioned diagonally across from each other). Each hand opening is positioned adjacent to the horizontal portion 16A of the rim. They are preferably spaced about one-half to three-fourths of an inch from this portion of the rim.

The horizontal portion of the rim has a width of about one inch.

A bead 24 is formed about three sides of each hand opening 22. A rib 26 extends between the exterior surface of the basket and the downwardly extending portion 16B of the rim at each side of the hand opening 22. The ribs 26 are formed integrally with the side walls 14 and both rim portions 16A, 16B, and provide greater strength near the hand openings, where strength is most needed. The basket is preferably molded from a relatively stiff material, as opposed to the soft polymeric materials commonly employed in molded laundry baskets. High density polyethylene may be successfully employed, and it is believed that polypropylene would also be acceptable.

An elongate opening 28 is formed in the rim 16 above each hand openings 22. A pair of opposing, elongate walls 30, 32 extend upwardly from the rim along two opposing sides of the openings 28. A pair of ribs 34 extends from the upper corner portions of the basket to facilitate unstacking of nested baskets.

Referring to FIGS. 2–9, handle members 36 are secured to opposing sides of the basket. Each handle member is molded from high density polyethylene or the like. The handle members extend about the rim 16 and adjoining side wall portions, and through the respective hand openings 22.

Each handle member includes a top portion 36A and a bottom portion 36B. The top portion 36A has a generally semicylindrical body 38 which is generally C-shaped in cross section. Two opposing, parallel end walls 40 extend generally perpendicularly from the inner surface of the body and include bottom surfaces which are adapted to flushly engage the upper surface of the rim 16. A pair of ribs 42 also extend from the inner surface of the body and add strength thereto. The ribs 42 are also adapted to flushly engage the upper surface of the rim.

The exterior surface of the top portion 36A is substantially uniformly curved. The outer edge portion 44 of the body 38 is stepped, and includes a tab 46 extending therefrom. The inner edge portion 48 of the body 38 is also stepped, but the step is located within the inner surface of the body rather than the exterior surface thereof. A recess 50 extends from this edge portion 48 and adjoins a centrally located rib 52. This rib 52 is adapted to flushly engage the upper surface of the rim 16.

Figure 3:
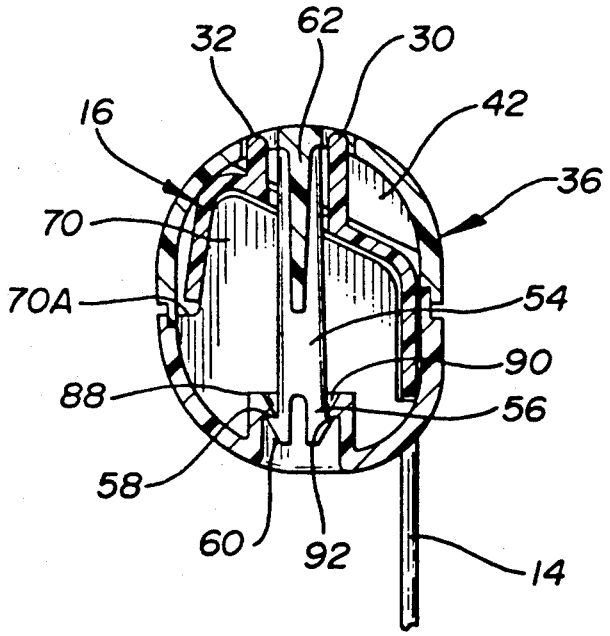
FIG. 3 is a sectional view taken along line 3—3 of FIG. 1.
Figure 6:
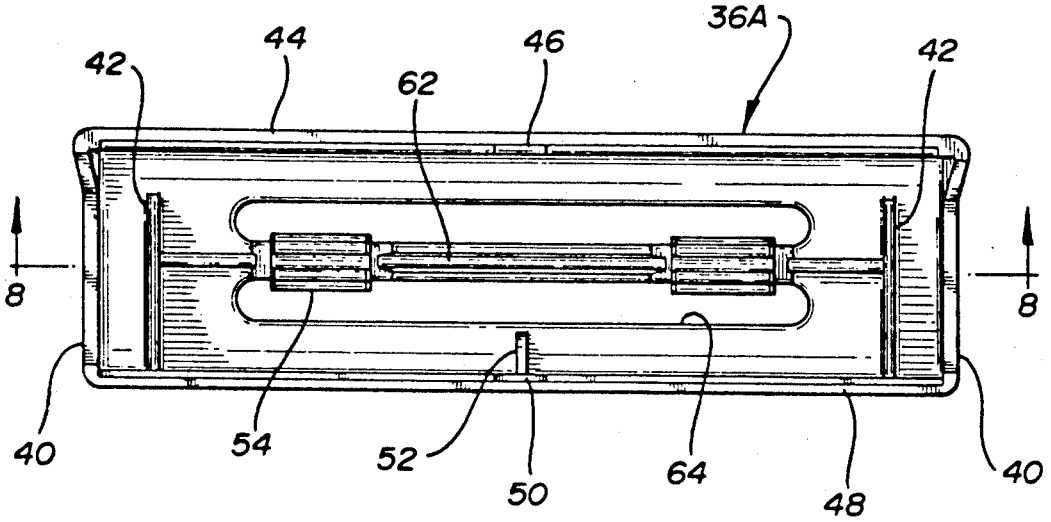
FIG. 6 is a bottom plan view of a top portion of a handle member according to the invention.
Figure 8:
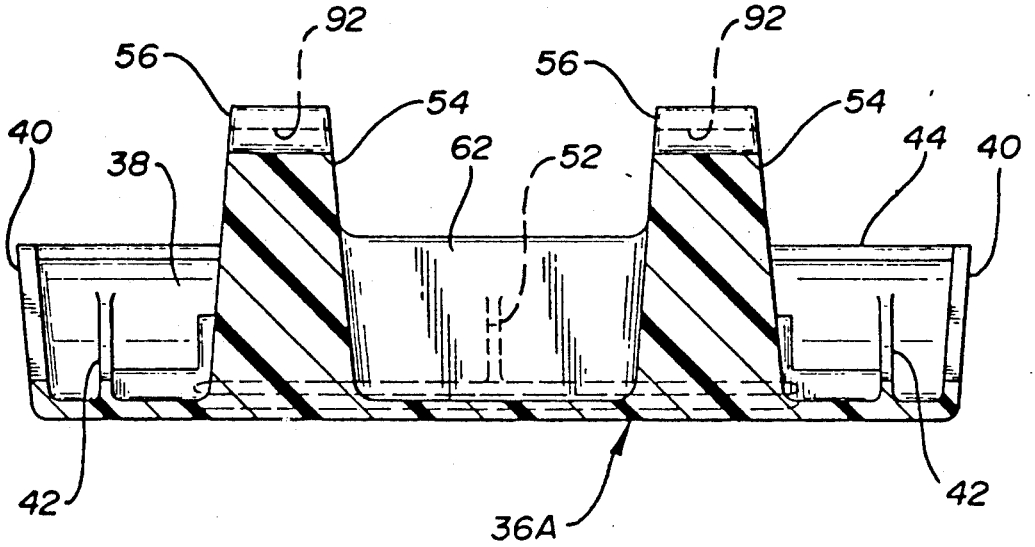
FIG. 8 is a sectional view taken along line 8—8 of FIG. 6.

First and second substantially identical protrusions 54 extend, respectively, from the inner surface of the body 38 of the top portion of the handle member 36. Each protrusion includes a bifurcated end 56 as shown in FIGS. 3, 6 and 8. Each half of the bifurcated end includes a shoulder 58 and a tapered end portion 60. A longitudinal wall 62 connects the two protrusions 54. Two elongate, parallel slots 64 are defined by the top portion of the longitudinal wall and the semicylindrical body 38. The slots 64 are adapted to receive the pairs of opposing walls 30, 32 extending upwardly from the rim 16.

The bottom portion 36B of the handle member 36 includes a generally semicylindrical body 66 which is generally C-shaped in cross section. A pair of end walls 68 extends from the inner surface of the body. Each end wall 68 includes top and side surfaces which correspond to the configuration of the rim 16 and adjoining side walls 14. A pair of ribs 70 having the same general configurations as the side walls also extends from the inner surface of the body 66.

A third, centrally positioned rib 72 having the same general configuration as the ribs 70 near the end walls 68 also extends from the inner surface of the body. This rib includes a slot 74 defined within its upper end.

The exterior surface of the bottom portion 36B of the handle member 36 is substantially uniformly curved. The inner edge portion 76 thereof is stepped, and includes an upwardly extending tab 78 which is adapted to fit within the recess 50 in the inner edge portion 4 of the top portion 36A of the handle member. The outer edge portion 80 of the body 66 is also stepped, but the step is defined within the inner surface thereof. A recess 82 extends from this edge portion 80. The recess 82 and edge portion 80 are adapted to receive the tab 46 and part of the edge portion 44 of the top portion 36A of the handle member 36, respectively.

Figure 2:
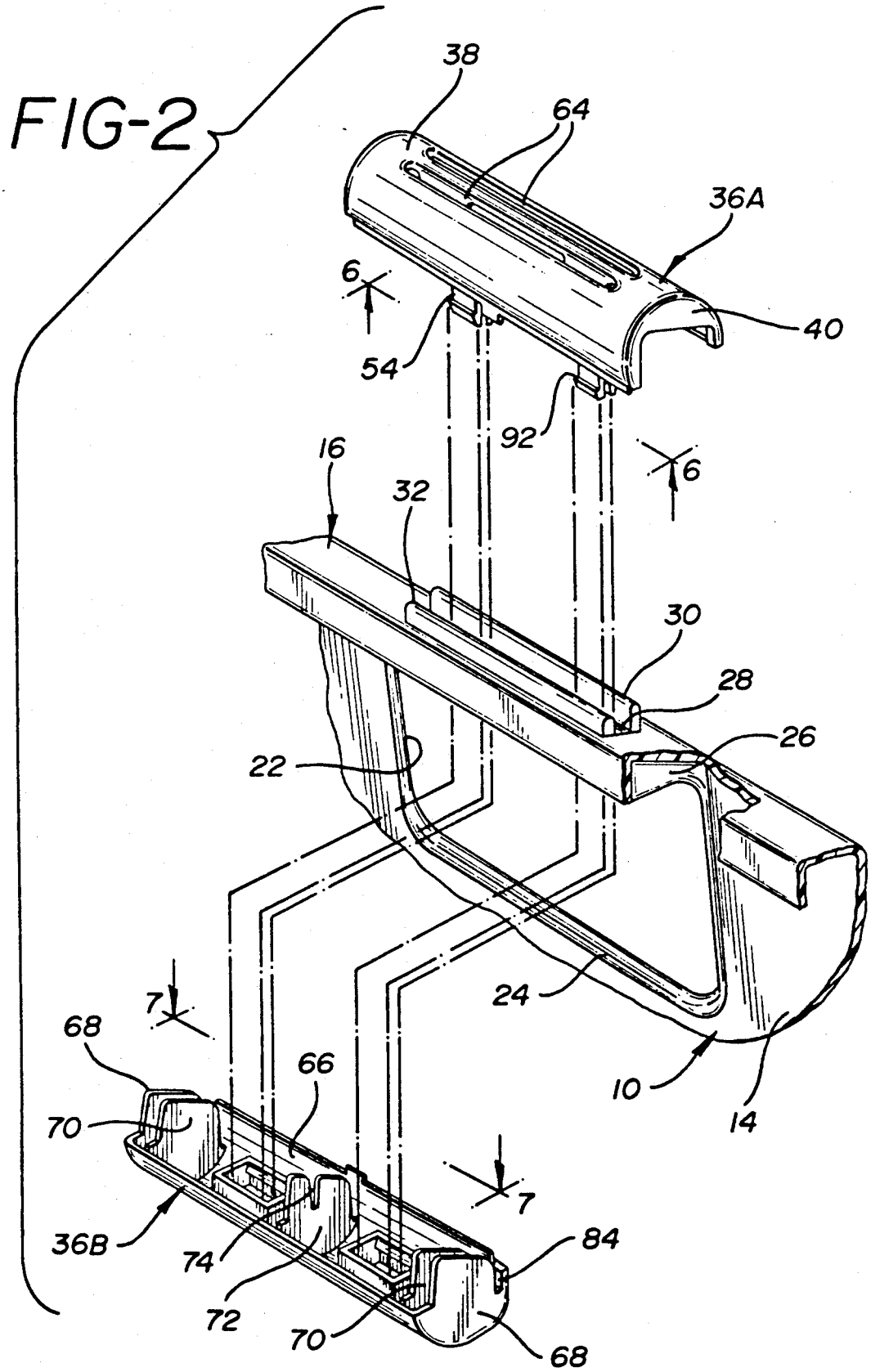
FIG. 2 is an exploded, perspective view thereof.
Figure 4:
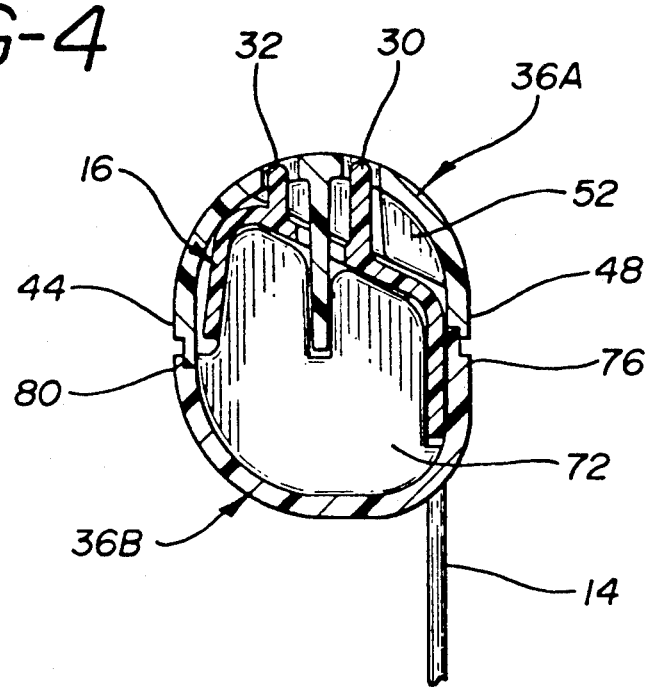
FIG. 4 is a sectional view taken along line 4—4 of FIG. 1.
Figure 5:
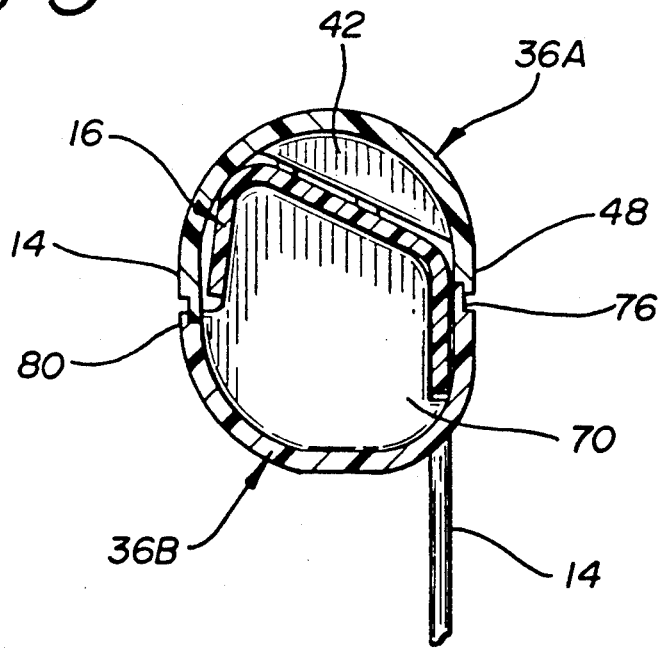
FIG. 5 is a sectional view taken along line 5—5 of FIG. 1.
Figure 7:
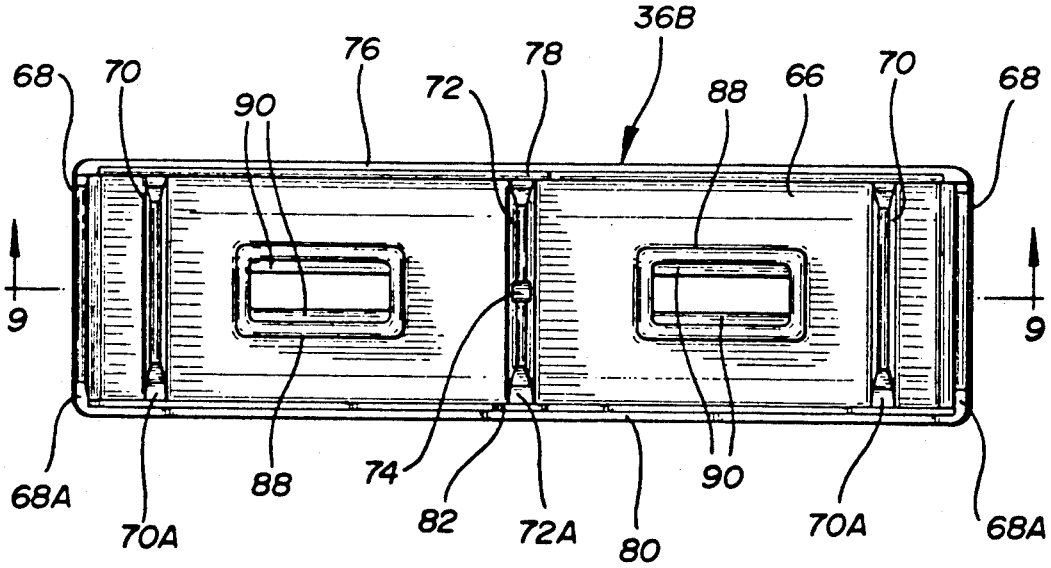
FIG. 7 is a top plan view of a bottom portion of a handle member according to the invention.

The end walls 68 and ribs 70, 72 extending laterally across the bottom portion 36B of the handle member 36 each adjoins the inner surface thereof near the outer edge portion 80 thereof, forming a plurality of coplanar shoulders 68A, 70A, 72A as shown in FIG. 7. The opposite sides of the end walls 68 and ribs 70, 72 are each positioned about an eighth of an inch from the inner edge portion 76 thereof. This arrangement provides a longitudinal slot 84 extending the length of the body 66, as shown in FIG. 2. The slot 84 is adapted to snugly receive the portion of the basket side wall 14 directly above either hand opening 22

Figure 9:
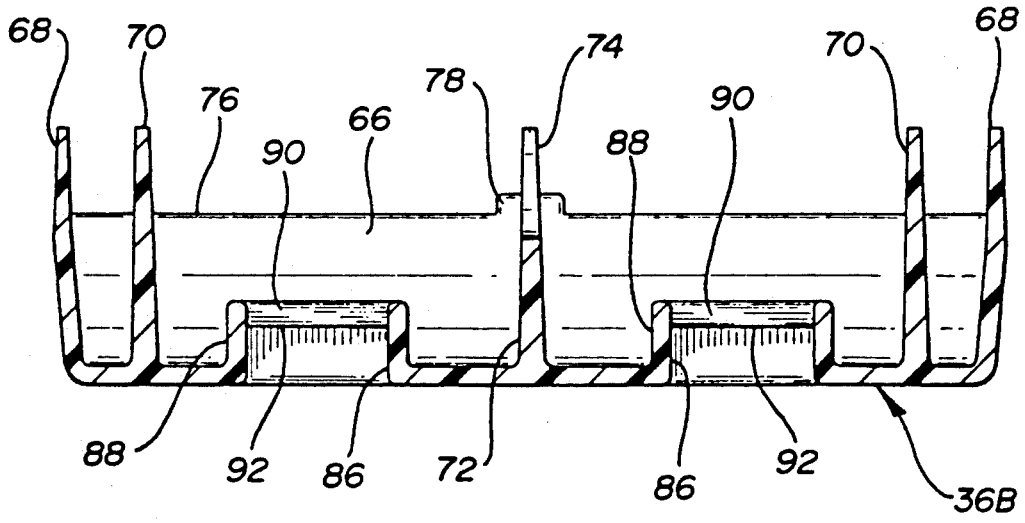
FIG. 9 is a sectional view taken along line 9—9 of FIG. 7.

A pair of rectangular openings 86 is defined in the lower surface of the bottom portion 36B of the handle member. A pair of rectangular tubes 88 extends upwardly from the interior surface of the body 66 and adjoins the openings 86 as shown in FIG. 9. Each tube 88 includes a pair of opposing, converging upper surfaces 90 which terminate at a pair of coplanar shoulders 92. The tubes 88 are adapted to receive the protrusions 54 of the top portion 36A of the handle member. The pairs of converging surfaces 90 are adapted to compress the respective bifurcated ends 56 of the protrusions 54 until the shoulders 58 thereof clear the shoulders 92. The bifurcated ends then spring fully open again, locking the ends 56 of the protrusions 54 behind the shoulders 92. The top and bottom portions of the handle member can thereby be permanently locked to each other and to the rim 16.

The constructions of the basket 10 and handle members 36 allow these molded components to be assembled to each other. The top portions 36A of the handle members are positioned above the hand openings 22 and urged downwardly until the protrusions 54 are fully inserted within the elongate openings 28. The basket is placed in an inverted position upon a fixture which supports the top handle portions 36A. The bottom portions 36B of the handle members are then positioned over the respective top portions and urged downwardly. The slots 74 in the centrally located ribs 72 receive the walls 62 connecting the respective sets of protrusions 54, and guide the bottom portions 36B as they are urged towards the rim 16. The series of shoulders 68A, 70A, 72A engage the bottom surface of the downwardly extending rim portions 16B. The upper surfaces of the end walls 68 and ribs 70, 72 flushly engage the lower surface of the generally horizontal rim portion 16A. Finally, the elongate slots 84 receive the side wall portions 14 above the respective hand openings 22.

The bifurcated ends 56 of the protrusions 54 of each top portion 36A are locked behind the shoulders 92 formed within the rectangular tubes 88. The tabs 46, 78 are simultaneously received in the respective recesses 82, 50. When locked in position, the bottom surfaces of the end walls 40 and ribs 42, 52 flushly engage the top surface of the rim 16. The opposing sides of the top portion 36A flushly engage the exterior surface of the downwardly extending portion 16B of the rim and an interior surface of one of the side walls 14, respectively. Finally, the upper surfaces of walls 30, 32 are substantially flush with the upper surface of the handle member 36.

The handle construction described above may be readily adapted to round or elliptical baskets or those having rims which are arcuate in cross section. The locking members of the top and bottom portions may also be reversed. Used with any type of rimmed basket, the handle members provide a large, round surface which facilitates a comfortable grip by the user. Once snapped together, the two pieces comprising each handle member form an integral part of the basket. One or both handle members may alternatively be formed as integral, molded parts of the basket itself.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A laundry basket comprising: a walled container including a peripheral rim and a pair of opposing hand openings adjacent said rim, and a pair of handle members extending, respectively, about said rim and through said hand openings, each of said handle members including a bottom portion positioned below the rim and defining an upper boundary of one of said hand openings and a top portion, said bottom portion being connected to said top portion, said bottom portion including a curved exterior surface;

said rim of said walled container including a pair of upper openings positioned, respectively, above said hand openings, one of said top or bottom portions of each of said handle members including a protrusion extending through said respective upper rim openings; and first and second pairs of opposing walls extending upwardly from said peripheral rim, the first pair of opposing walls adjoining one of the upper rim openings, the second pair of opposing walls adjoining the other of the upper rim openings, said top portions of said handle members each including a pair of slots which receive one of said pairs of opposing walls.

2. A laundry basket as described in claim 1 wherein said top portions of said handle members respectively include said protrusions.

3. A laundry basket as described in claim 2 wherein each of said bottom portions of said handle members includes an opening for receiving one of said protrusions.

4. A laundry basket as described in claim 2 wherein said protrusions are lockingly engaged to said respective bottom portions of said handle members.

5. A laundry basket as described in claim 1 wherein each of said top portions of said handle members includes a pair of protrusions defining a pair of male locking members, each of said bottom portions of said handle members including a pair of complementary female locking members which lockingly receive said male locking members.

6. A laundry basket as described in claim 5 wherein each of said top portions of said handle members includes a wall connecting one of the pairs of projections, each of said bottom portions of said handle members including a slot which receives one of said connecting walls.

7. A laundry basket as described in claim 6 including first and second pairs of opposing walls extending upwardly from said peripheral rim, the first pair of opposing walls adjoining one of the upper rim openings, the second pair of opposing walls adjoining the other of the upper rim openings, said walls connecting said pairs of projections being positioned, respectively, between said first and second pairs of opposing walls.

8. A laundry basket as described in claim 1 wherein said peripheral rim includes a generally horizontal portion and a downwardly extending portion opposing the exterior surface of said walled container, said bottom portions of said handle members each being positioned at least partially between the downwardly extending portion of the rim and the exterior surface of said walled container.

9. A laundry basket as described in claim 8 wherein said top portions of said handle members each includes a lower surface which substantially flushly engages the upper surface of said peripheral rim.

10. A laundry basket as described in claim 1 wherein said handle members each includes a narrow, elongate slot which receives a portion of said walled container adjacent to one of the respective hand openings.

11. A laundry basket as described in claim 10 wherein said elongate slot is formed in said bottom portion of each of said handle members, the curved exterior surface of each bottom portion defining an upper boundary of one of said hand openings.

* * * * *